US006526792B1

(12) United States Patent
Pehle

(10) Patent No.: US 6,526,792 B1
(45) Date of Patent: Mar. 4, 2003

(54) METHOD FOR MINIMIZING THICKENED ENDS DURING THE ROLLING OF PIPES IN A STRETCH REDUCING MILL

(75) Inventor: Hans Joachim Pehle, Jüchen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/786,035

(22) PCT Filed: May 11, 1999

(86) PCT No.: PCT/DE99/01459

§ 371 (c)(1),
(2), (4) Date: Feb. 28, 2001

(87) PCT Pub. No.: WO00/12237

PCT Pub. Date: Mar. 9, 2000

(30) Foreign Application Priority Data

Aug. 31, 1998 (DE) ..... 198 40 864

(51) Int. Cl.[7] ..... B21B 37/72

(52) U.S. Cl. ..... 72/12.5; 72/8.8; 72/10.3; 72/234; 72/365.2

(58) Field of Search ..... 72/8.8, 10.3, 11.5, 72/12.5, 205, 234, 235, 279, 365.2

(56) References Cited

U.S. PATENT DOCUMENTS

| | | | | | |
|---|---|---|---|---|---|
| 4,002,048 | A | * | 1/1977 | Pozsgay | 72/234 |
| 4,430,875 | A | * | 2/1984 | Denny et al. | 72/205 |
| 4,984,444 | A | * | 1/1991 | Franceschina | 72/205 |
| 5,129,250 | A | * | 7/1992 | Palma et al. | 72/234 |
| 5,533,370 | A | * | 7/1996 | Kuroda et al. | 72/235 |

* cited by examiner

*Primary Examiner*—Ed Tolan
(74) *Attorney, Agent, or Firm*—Cohen, Pontani, Lieberman & Pavane

(57) ABSTRACT

The invention relates to a method for minimizing thickened ends during the rolling of tubes in a stretch-reducing mill by means of a change in time of the torque of individual driven roll stands when the tube front end and the tube rear end run through the stretch-reducing mill, so that the tube ends are rolled with higher roll speeds than the steady-state speeds. At the same time, lower roll speeds than the steady-state roll speeds are set between the steady-state and the increased roll speeds.

4 Claims, 1 Drawing Sheet

METHOD FOR MINIMIZING THICKENED ENDS DURING THE ROLLING OF PIPES IN A STRETCH REDUCING MILL

PRIORITY CLAIM

This is a U.S. national stage of application No. PCT/DE99/01459, filed on May 11, 1999. Priority is claimed on that application and on the following application: Country: Germany, Application No.: 198 40 864.1, Filed: Aug. 31, 1998.

BACKGROUND OF THE INVENTION

1. Field of the Invention

The invention relates to a method for minimizing thickened ends during the rolling of tubes in a stretch-reducing mill by means of a change in time of the torque of individually driven roll stands when the tube front end or the tube rear end runs through the stretch-reducing mill, so that the tube ends are rolled with higher roll speeds than the steady-state roll speeds.

2. Description of the Related Art

The high longitudinal tensile stresses during the stretch-reduction of tubes increase the occurrence of so-called "thickened ends", which designate the regions occurring at the tube ends as a result of diminished effective stretching. The cause of the lower stretching of the tube ends, as compared with the tube middle part, is that the roll speeds designed for the steady-state operating conditions are generally not sufficiently high to build up maximum tensile stresses at the tube ends in physical terms. As compared with the tube middle part rolled in a steady-state manner, the tube ends have a greater wall thickness which increases toward the tube end. When this wall thickness exceeds the permissible tolerance limit, these end portions have to be cropped from the finished tube.

A measure of the size of the increase in wall thickness at the tube ends is the difference between the tensile stresses acting in the steady-state state and in the non-steady-state conditions at each individual forming step, that is to say in each stand. Due to different forming operations, the wall thickness profiles at the front and the rear tube portion, as seen in the rolling direction, differ from one another; they consist essentially of the wall thickness, the wall thickness profile and the length of the region with increased wall thickness.

The thickened tube ends located outside the tolerance are detached, which means rejects which may markedly lower productivity. Methods have therefore had to be worked out, by means of which the forming of the thickened tube ends could be prevented or at least minimized to an extent such that the end losses remained as low as possible.

It turned out that end losses can be kept low if stress and deformation conditions which are close to the steady-state forming conditions are set at the tube ends by means of controlled changes in the drive motor rotational speeds of the stretch-reducing mill. If the tensile stress acting on the tube ends is increased in the entry and exit phases of the rolling process by an increase in the roll speeds and the increase in the wall thickness beyond the tolerance dimension is thus counteracted, the material losses caused by end thickenings can be reduced. The tensile stress profiles are calculated in known tube end controls in such a way that a maximum possible tensile stress is determined, while care must be taken to ensure that a not yet thickened tube portion is not subjected to higher tensile stresses than the steady-state tensile stresses, because the finished tube may otherwise fall short of the tube wall thicknesses produced under steady-state forming conditions.

However, so that a change in rotational speed can be carried out it is necessary to have a rapid drive system capable of being regulated individually in terms of the roll rotational speed. Both group variable-ratio drives with suitable group division and individual drives may be considered for the drive.

In the known methods, particularly at the front tube end which is short, that is compared with the rear tube end, an only slight reduction in the thickened ends is achieved; this is because the increase in the roll speeds is limited by the inadmissible wall thinnings occurring between the good tube region and the thickened ends. Narrower localization of the tensile stress increase by means of a smaller number of stands involved in the roll speed increase would be necessary, especially since it is possible to influence the end thickening effectively during the entry phases only in a limited number of stands arranged on the entry side. By means of the known methods for changing the roll speed, however, a reduction in the stands involved is not possible, because, with a smaller number of stands, less tensile stress can be applied.

SUMMARY OF THE INVENTION

The object of the present invention is to increase and localize the effect of the known tube end control, in order to minimize further or to prevent the occurrence of thickened tube ends.

To achieve the object, according to the invention, lower roll speeds than the steady-state roll speeds are set between the steady-state and the increased roll speeds. These lower roll speeds act on parts of the tubes adjacent to the ends. By virtue of the invention, a controlled wall thickening is set by means of the roll speeds reduced in relation to the steady-state rolling conditions, that is to say, on the one hand, the tensile stress increase is localized and is adapted more closely to the region of the wall thickening and, on the other hand, a possible inadmissible wall thinning in the region between the thickened tube end and the good tube is compensated again. With the aid of the method according to the invention for changing the roll speed, inadmissible wall thinnings can be avoided and therefore even higher roll speeds can be set, so that a reduction in the thickened ends can be achieved.

Although the method according to the invention can be applied both with group variable-ratio drives and with individual drives, there is a particular advantage in that the disadvantage of the individual electric drive causing an increased end loss at the front tube end on account of a collapse of roll speed due to impact load can be avoided by relatively simple means as a result of the new roll speed control method.

BRIEF DESCRIPTION OF THE DRAWINGS

The invention is graphically illustrated and explained by means of three graphs in which.

DETAILED DESCRIPTION OF THE PREFERRED EMBODIMENTS

Figure 1:
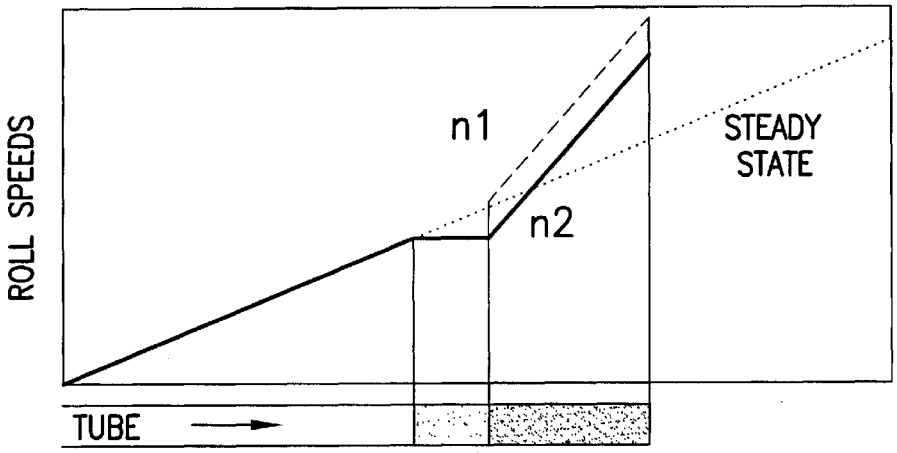
FIG. 1 shows the roll speed profile against the tube length.

In all three figures of the drawing, the curved profile of the prior art is illustrated by dashes and that of the invention is depicted by an unbroken line. The steady-state conditions of the stretch-reducing mill is illustrated by dots.

Figure 2:
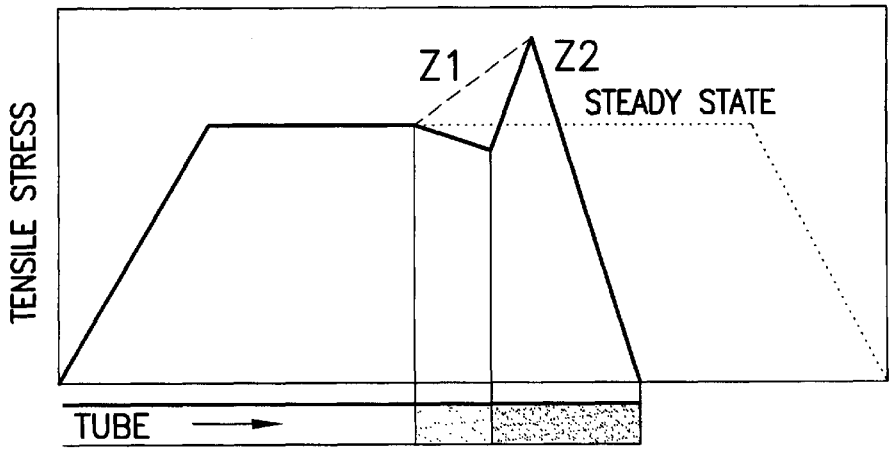
FIG. 2 shows the tensile stress profile against the tube length.
Figure 3:
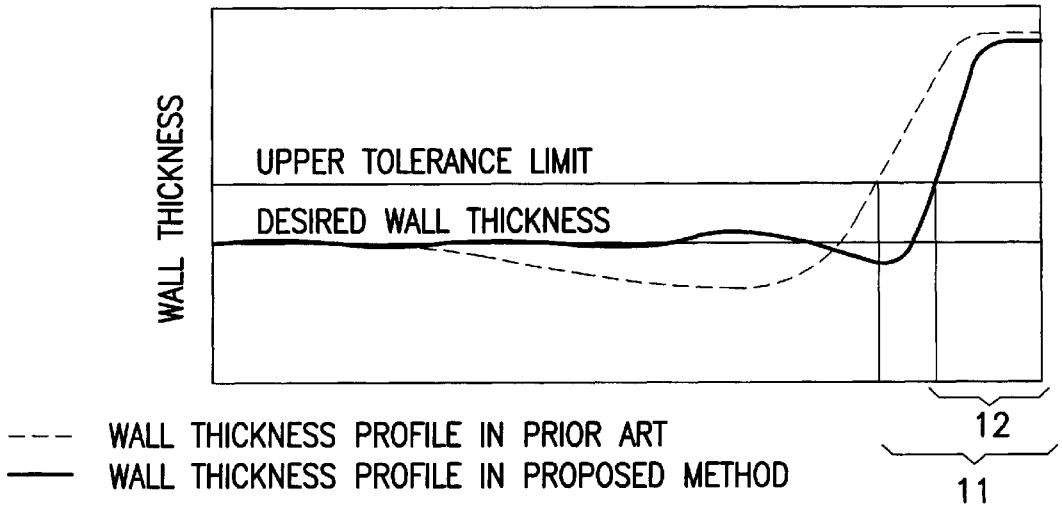
FIG. 3 shows the profile of the tube wall thickness in the transitional region between the good tube and the thickened end.

It can be seen in FIG. 1 that the roll speeds of the steady-state conditions, in simplified form, follow a linearly rising straight line and that during the entry of the tube end the roll speed ratios n1 are increased. The tensile stress increase z1 in FIG. 2 is localized, at the same time, by means of a smaller number of stands involved in the roll speed increase, thus resulting in the wall thickness profile which is illustrated by dashes in FIG. 3. It can be seen that, in the region between the thickened ends (on the right in FIG. 3) and the region of the good tube (on the left in FIG. 3), a tube portion is formed in which the wall thickness profile can be seen to be below the tolerance limit.

If, then, according to the invention, lower roll speed ratios than the steady-state roll speeds are set between the increased roll speeds and the steady-state roll speeds, as is illustrated by the unbroken line in FIG. 1 of the drawing, then, on the one hand, the tensile stress increase is localized, as can be seen at z2 in FIG. 2, and is consequently adapted more closely to the region of the wall thickening. At the same time, as shown by the unbroken curve in FIG. 3, a possibly inadmissible wall thinning in the region between the thickened tube end and the good tube is compensated again, so that inadmissible wall thinnings are avoided. Even higher roll speeds can be set in this way, thus resulting in a reduction in the thickened tube ends, as was made clear in FIG. 3 by the length 11 and the length 12, with 12<11.

What is claimed is:

1. A method of rolling tubes in a stretch reducing mill having a plurality of individually driven roll stands, said method comprising feeding a tube through said plurality of roll stands, said tube having a front end, a rear end, a middle part between said ends, and parts adjacent to said tube ends between respective said tube ends and said middle part, while said middle part is being fed through said roll stands, driving the roll stands acting on the middle part of the tube with steady state roll speeds, while said ends are being fed through said roll stands, driving the roll stands acting on the ends with roll speeds which are higher than said steady state roll speeds, and while said adjacent parts are being fed through said roll stands, driving the roll stands acting on the adjacent parts with roll speeds which are lower than said steady state roll speeds.

2. A method as in claim 1, wherein the steady state roll speeds acting on the middle part of tube increase substantially linearly from stand to stand.

3. A method of rolling tubes in a stretch reducing mill having a plurality of individually driven roll stands, said method comprising feeding a tube through said plurality of roll stands, said tube having a front end, a rear end, a middle part between said ends, and parts adjacent to said tube ends between respective said tube ends and said middle part, while said middle part is being fed through said roll stands, driving the roll stands acting on the middle part of the tube with steady state roll speeds, and while said front end is being fed through said roll stands, driving the roll stands acting on the front end with roll speeds which are higher than the steady state roll speeds, driving the roll stands acting on the part adjacent to said front end with rolls speeds which are lower than the steady state roll speeds, and driving the middle part with said steady state roll speeds.

4. A method as in claim 3, wherein the steady state roll speeds acting on the middle part of tube increase substantially linearly from stand to stand.

* * * * *